US006571681B2

(12) United States Patent
Sakurai

(10) Patent No.: US 6,571,681 B2
(45) Date of Patent: Jun. 3, 2003

(54) ATTACHMENT STRUCTURE FOR POSITION-DETECTING SENSOR

(75) Inventor: Koji Sakurai, Koshigaya (JP)

(73) Assignee: SMC Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/920,645

(22) Filed: Aug. 3, 2001

(65) Prior Publication Data

US 2002/0017190 A1 Feb. 14, 2002

(30) Foreign Application Priority Data

Aug. 4, 2000 (JP) ..... 2000-237812

(51) Int. Cl.[7] ..... F01B 25/26; F01B 31/12
(52) U.S. Cl. ..... 92/5 R; 91/1
(58) Field of Search ..... 92/5 R, 5 L; 91/1

(56) References Cited

U.S. PATENT DOCUMENTS 2,914,630 A * 11/1959 Ralston ..... 92/5 R X
4,086,456 A * 4/1978 Bone ..... 92/5 R X
4,176,586 A * 12/1979 Stoll et al. ..... 92/5 R X
4,230,023 A * 10/1980 Ward ..... 92/5 R X
4,594,487 A * 6/1986 Grassl et al. ..... 200/82 E
4,757,657 A * 7/1988 Mitchell et al. ..... 403/12
4,793,241 A * 12/1988 Mano et al. ..... 92/5 R X
4,800,241 A * 1/1989 McNamara ..... 200/294
4,896,584 A * 1/1990 Stoll et al. ..... 92/5 R X
5,103,172 A * 4/1992 Stoll ..... 92/5 L X
5,813,313 A * 9/1998 Stoll et al. ..... 92/5 R X
6,089,111 A * 7/2000 Machijima ..... 92/5 L X

OTHER PUBLICATIONS

U.S. patent application Ser. No. 09/795,348, filed Mar. 1, 2001, by Koji Sakurai et al., status pending.
U.S. Design patent application Ser. No. 29/145,323 by Koji Sakurai, filed on Jul. 19, 2001.

* cited by examiner

*Primary Examiner*—Edward K. Look
*Assistant Examiner*—Michael Leslie
(74) *Attorney, Agent, or Firm*—Paul A. Guss

(57) ABSTRACT

An attachment structure for a position-detecting sensor includes a sensor attachment mechanism having a rail member which is secured to an outer side surface of a cylinder tube and a holder which holds the position-detecting sensor and which is provided slidably along the rail member, wherein chamfered sections, each of which is chamfered with a predetermined radius of curvature, are formed for the rail member and the holder. As a result, the attachment position of the position-detecting sensor can be arbitrarily adjusted in a stroke direction of a cylinder.

21 Claims, 17 Drawing Sheets

ATTACHMENT STRUCTURE FOR POSITION-DETECTING SENSOR

BACKGROUND OF THE INVENTION

1. Field of the Invention

The present invention relates to an attachment structure for a position-detecting sensor having a function to adjust its detection position.

2. Description of the Related Art

A fluid pressure-operated cylinder has been hitherto used as a driving means for transporting and positioning a workpiece and driving various industrial machines. In order to meet various needs of the user, for example, miniaturization and improvement of multiple functions in option setting or the like, the fluid pressure-operated cylinder is provided with a cylinder tube and accessory parts such as switches attached to the cylinder tube.

If liquid is kept on outer surfaces of a cylinder tube and a switch, various germs may be propagated in the liquid. Therefore, the present applicant proposed a sanitary position-detecting sensor. According to the position-detecting sensor, liquid naturally drips down from the surfaces of the cylinder tube and the switch. Therefore, the liquid is hardly kept on the surfaces of the cylinder tube and the switch. Though the position-detecting sensor has a position-adjusting mechanism, the main body of the position-detecting sensor is small. Therefore, the overall position-detecting sensor has a small size and a light weight (see U.S. patent application Ser. No. 09/795348).

SUMMARY OF THE INVENTION

A general object of the present invention is to provide an attachment structure for a position-detecting sensor in which the attachment position of the position-detecting sensor in the direction of stroke of a cylinder can be arbitrarily adjusted, the liquid is scarcely kept on the outer surface, and it is possible to avoid the sanitary problem.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

Figure 1:
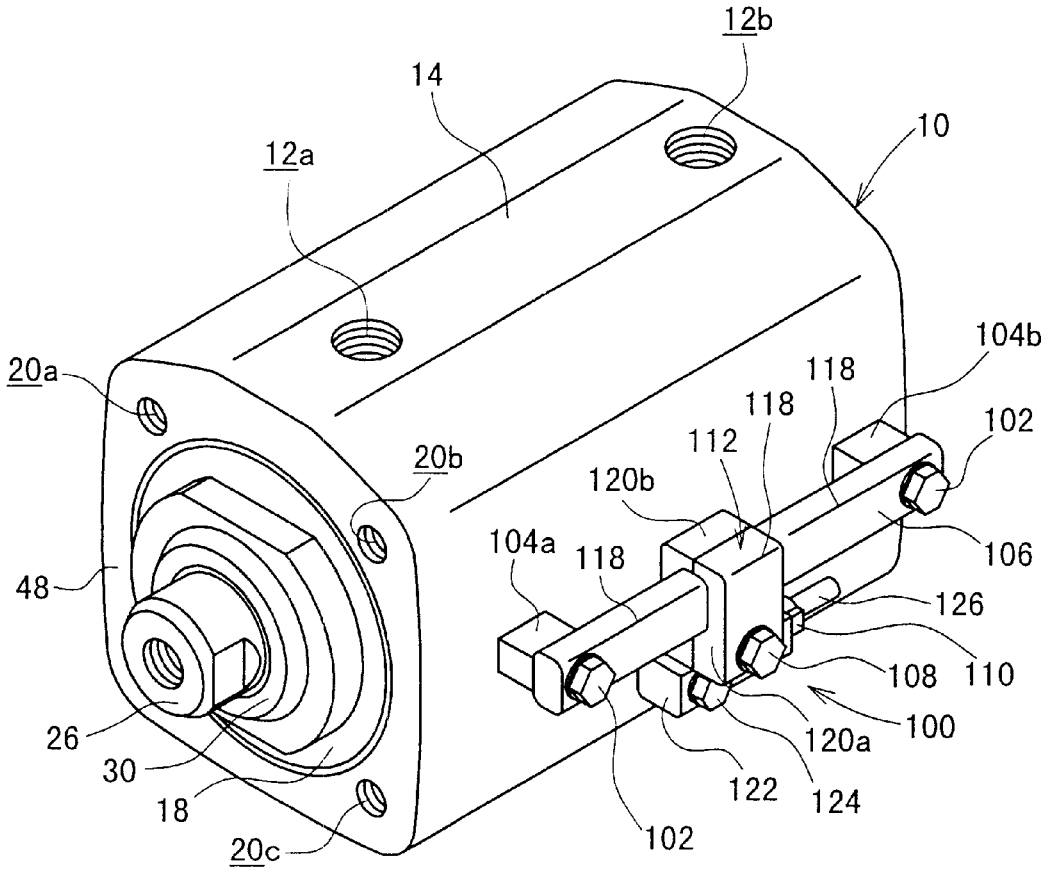
FIG. 1 shows a perspective view illustrating a state in which a position-detecting switch is equipped on a side surface of a cylinder by the aid of a sensor attachment mechanism according to an embodiment of the present invention.

With reference to FIG. 1, reference numeral 10 indicates a cylinder which is equipped with a position-detecting sensor by the aid of a sensor attachment mechanism according to an embodiment of the present invention.

Figure 3:
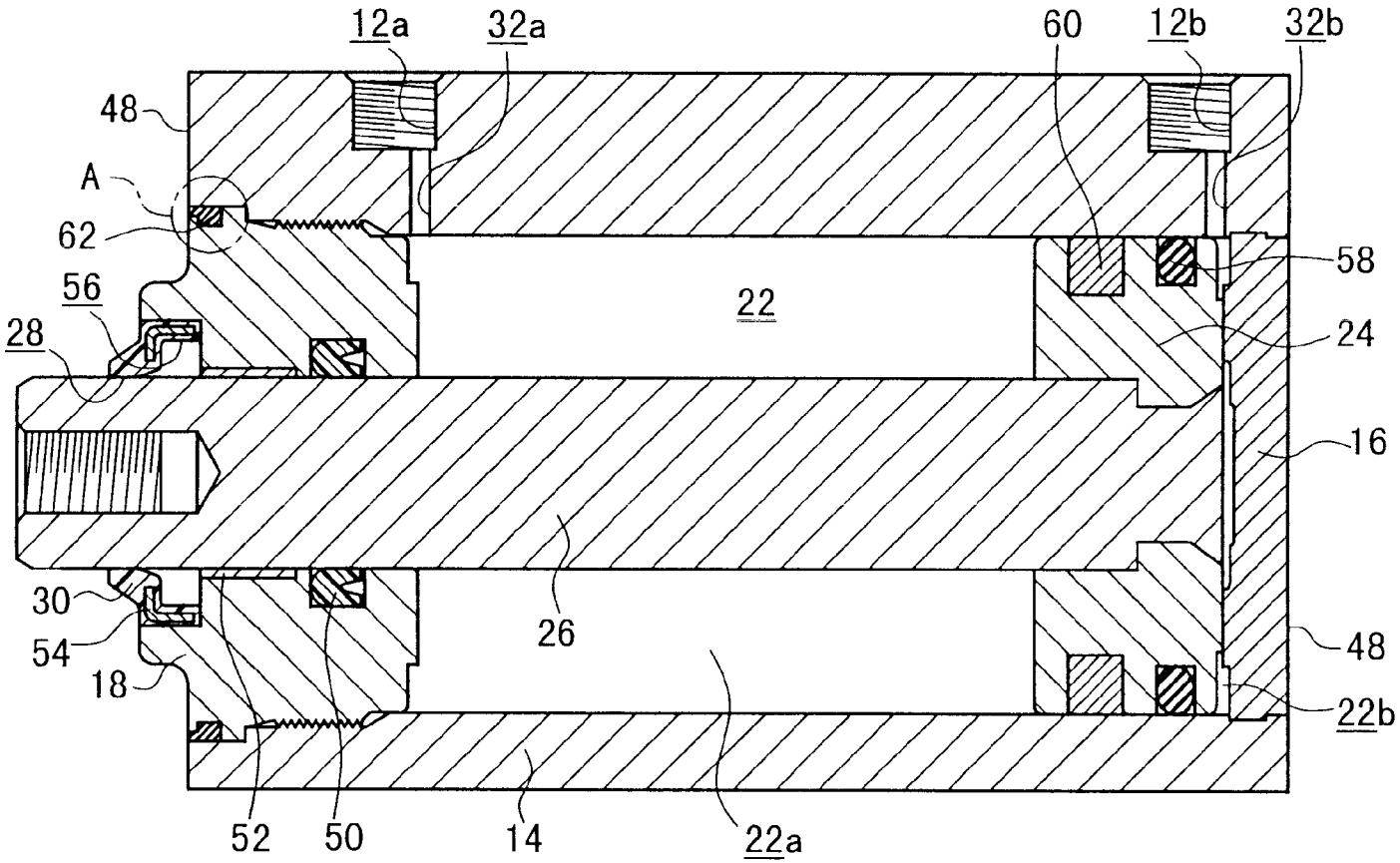
FIG. 3 shows a longitudinal sectional view taken along a line III—III shown in FIG. 2.

The cylinder 10 includes a substantially cylindrical cylinder tube 14 having a pair of pressure fluid inlet/outlet ports 12*a*, 12*b* separated from each other by a predetermined spacing distance, a head cover 16 secured to an end of the cylinder tube 14, and a rod cover 18 fitted into a screw hole on the other end of the cylinder tube 14 (see FIG. 3).

Figure 2:
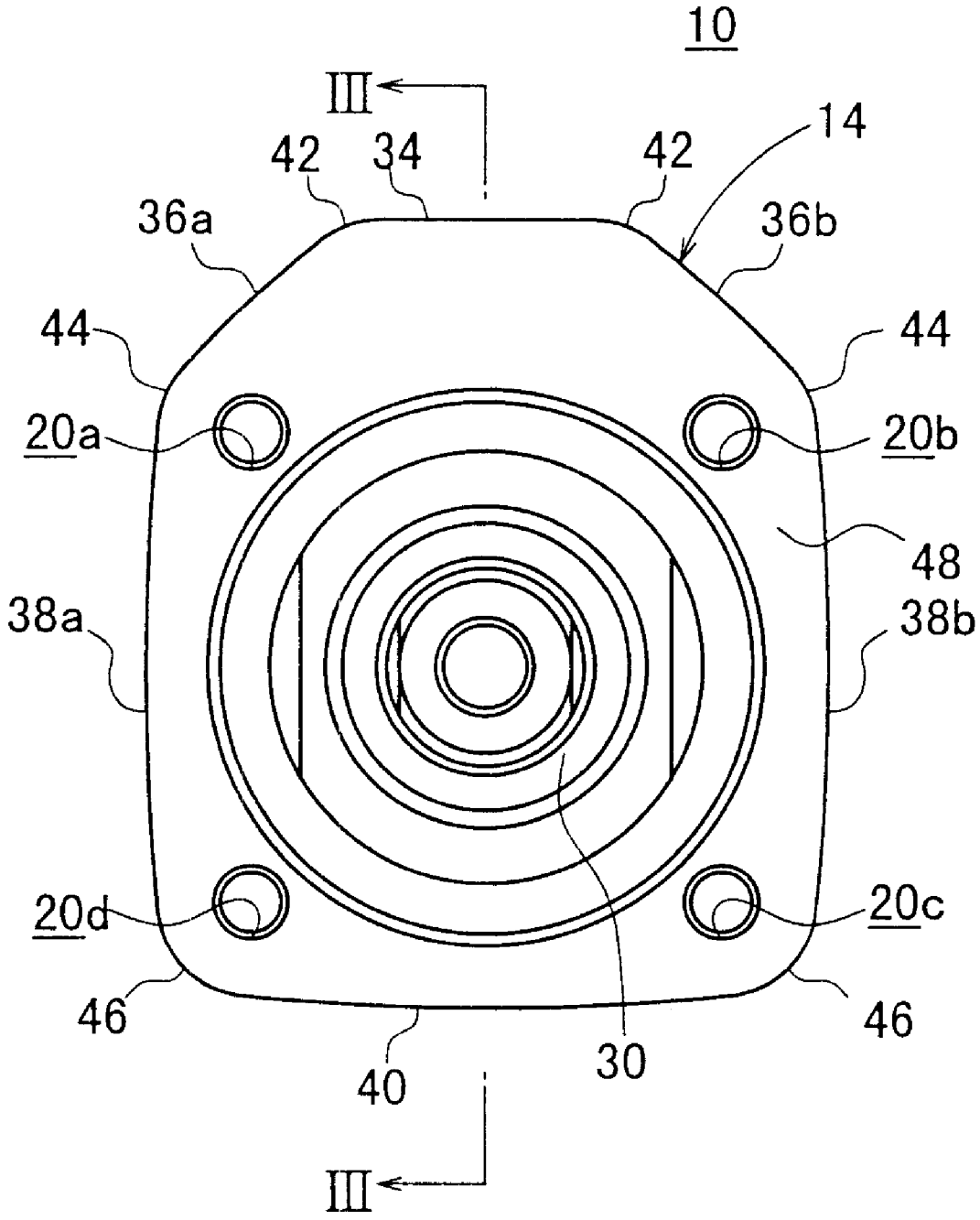
FIG. 2 shows a front view illustrating the cylinder shown in FIG. 1.

As shown in FIGS. 1 and 2, the cylinder tube 14 is formed with four attachment holes 20*a* to 20*d* which makes penetration in the axial direction. The cylinder 10 can be conveniently attached, for example, to a wall surface by screwing unillustrated screw members into screw portions of the attachment holes 20*a* to 20*d* or by inserting unillustrated bolts into the attachment holes 20*a* to 20*d*.

As shown in FIG. 3, the cylinder 10 further includes a piston 24 which is displaceable along a cylinder chamber 22 closed by the head cover 16 and the rod cover 18 in the cylinder tube 14, a piston rod 26 which has an end fastened to the piston 24 and the other end exposed to the outside, and a scraper 30 which is installed to an annular recess of the rod cover 18 and which is formed with a hole 28 for surrounding the outer circumferential surface of the piston rod 26.

The pair of pressure fluid inlet/outlet ports 12*a*, 12*b* are provided to make communication with the cylinder chamber 22 via passages 32*a*, 32*b* respectively.

As shown in FIG. 2, the outer circumferential surface of the cylinder tube 14 includes, in the circumferential direction, an upper surface 34 which is formed with the pair of pressure fluid inlet/outlet ports 12*a*, 12*b*, a pair of inclined surfaces 36*a*, 36*b* which are continued to the upper surface 34 and which are inclined by predetermined angles, a pair of side surfaces 38*a*, 38*b* which are continued to the inclined surfaces 36*a*, 36*b* and which are opposed to one another, and a bottom surface 40 which is continued to the pair of side surfaces 38*a*, 38*b* respectively.

First chamfered sections 42, each of which has a predetermined radius of curvature, are formed at boundary portions between the upper surface 34 and the inclined surfaces 36*a*, 36*b*. Second chamfered sections 44, each of which has a predetermined radius of curvature, are formed at boundary portions between the inclined surfaces 36*a*, 36*b* and the side surfaces 38*a*, 38*b*. Third chamfered sections 46, each of which has a predetermined radius of curvature, are formed at boundary portions between the side surfaces 38*a*, 38*b* and the bottom surface 40.

In this arrangement, the upper surface 34, the pair of inclined surfaces 36*a*, 36*b*, the pair of side surfaces 38*a*, 38*b*, and the bottom surface 40, which constitute the outer circumferential surface of the cylinder tube 14, have the predetermined radiuses of curvature respectively, and they are formed by curved surfaces which are convex toward the outside.

As described above, all of the outer circumferential surface portions of the cylinder tube 14, which are disposed in the circumferential direction of the cylinder tube 14, are constructed by the outwardly convex curved surfaces and the first to third chamfered sections 42, 44, 46. Further, the other side surfaces except for the outer circumference surfaces disposed in the circumferential direction described above are formed as the upstanding surfaces (substantially vertical surfaces) 48. Accordingly, the cylinder tube 14 is designed to have such a shape that any liquid adhered to the outer surface of the cylinder tube 14 spontaneously drips and falls.

Therefore, no liquid pool appears, because no recess is formed on the outer circumferential surface of the cylinder tube 14 disposed in the circumferential direction. It is possible to avoid such a sanitary problem that various germs are propagated due to the liquid.

As shown in FIG. 3, the head cover 16 is caulked into the hole of the cylinder tube 14. The connecting portion between the head cover 16 and the cylinder tube 14 is formed to function as a metal seal which retains the cylinder chamber 22 in an air-tight manner and which prevents invasion of liquid or the like from the outside.

A rod packing 50 is installed to the inner circumferential surface of the rod cover 18 by the aid of an annular groove. The outer circumferential surface of the piston rod 26 is surrounded by the rod packing 50, and thus the cylinder chamber 22 is held in an air-tight manner and in a liquid-tight manner. A cylindrical bush 52 is installed to an annular recess which is formed on the inner circumferential surface of the rod cover 18. The scraper 30, in which a metal piece 54 is molded with a rubber material, is installed to an annular recess which is formed at the end of the rod cover 18. An annular chamber 56, which functions as an oil pool for lubricating oil adhered to the outer circumferential surface of the piston rod 26, is formed between the scraper 30 and the rod cover 18.

A piston packing 58, which makes sliding contact with the inner wall surface of the cylinder chamber 22 and which divides the cylinder chamber 22 into a first cylinder chamber 22*a* and a second cylinder chamber 22*b*, is installed to the outer circumferential surface of the piston 24 by the aid of an annular groove. Further, a magnet 60, which is composed of a ring member to surround the piston 24, is installed at a portion disposed in the vicinity of the piston packing 58 by the aid of an annular groove.

Figure 4:
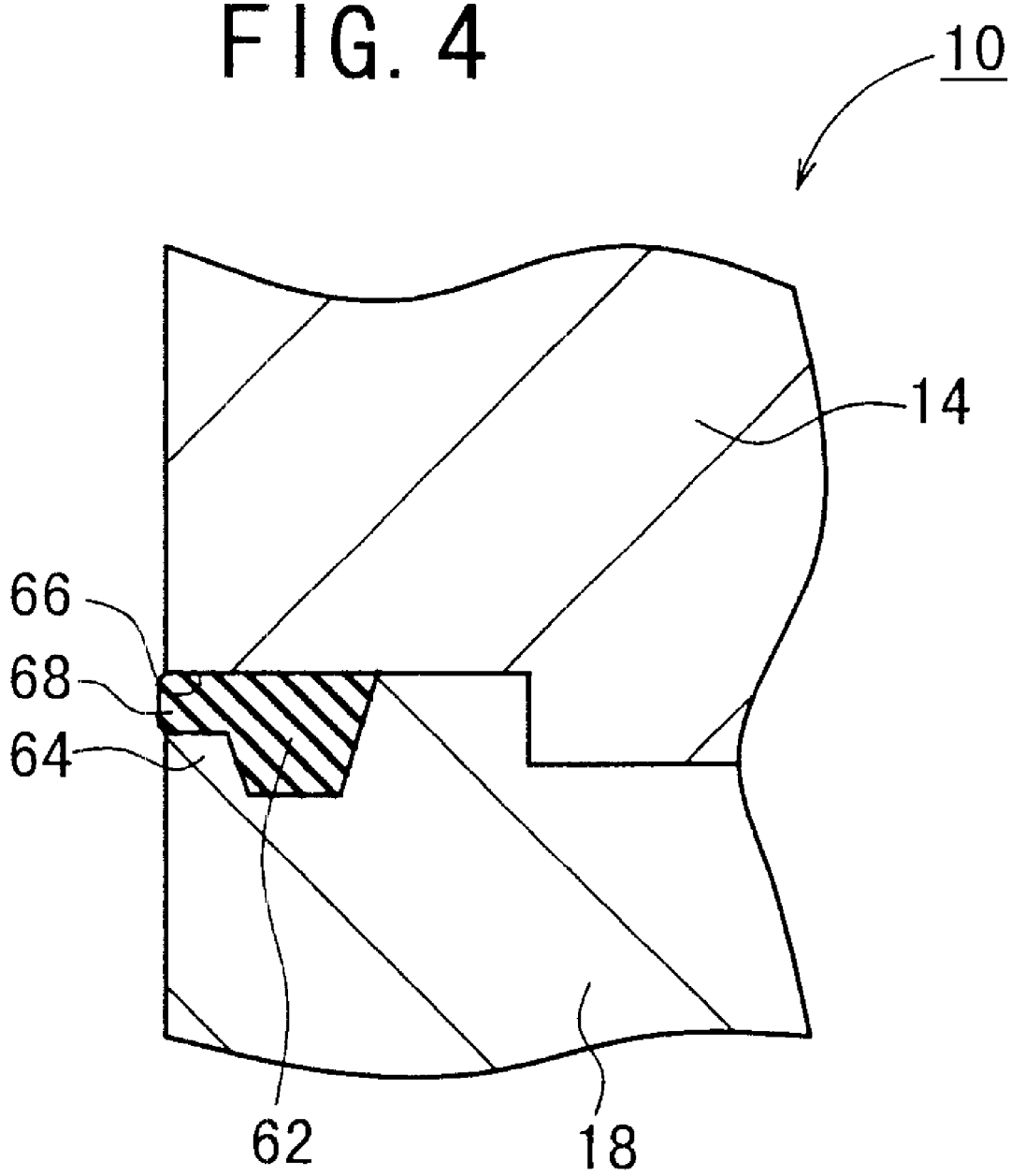
FIG. 4 shows a magnified longitudinal sectional view illustrating portion A shown in FIG. 3.

An annular seal member 62, which is formed of a flexible material such as rubber, is provided at one end of the connecting portion between the cylinder tube 14 and the rod cover 18 in the axial direction. As shown in FIG. 4, a part of the seal member 62 is installed in a state of being forcibly interposed by a narrow spacing distance between an inner circumferential surface 66 of the cylinder tube 14 and an annular projection 64 formed on the rod cover 18.

That is, the annular seal member 62, which is formed to have its substantially constant wall thickness in the circumferential direction, is previously provided with a press margin to be forcibly interposed between the inner circumferential surface 66 of the cylinder tube 14 and the annular projection 64 formed on the outer circumferential surface of the rod cover 18. Therefore, even when any liquid or the like intends to enter the connecting portion between the cylinder tube 14 and the rod cover 18, the sealing is reliably effected by a forcibly interposed section 68 of the seal member 62. Thus, the liquid or the like does not enter the cylinder tube 14.

A pair of screw holes (not shown), which are separated from each other by a predetermined spacing distance, are formed on the side surface of the cylinder tube 14 in order to attach a rail member as described later on.

Figure 8:
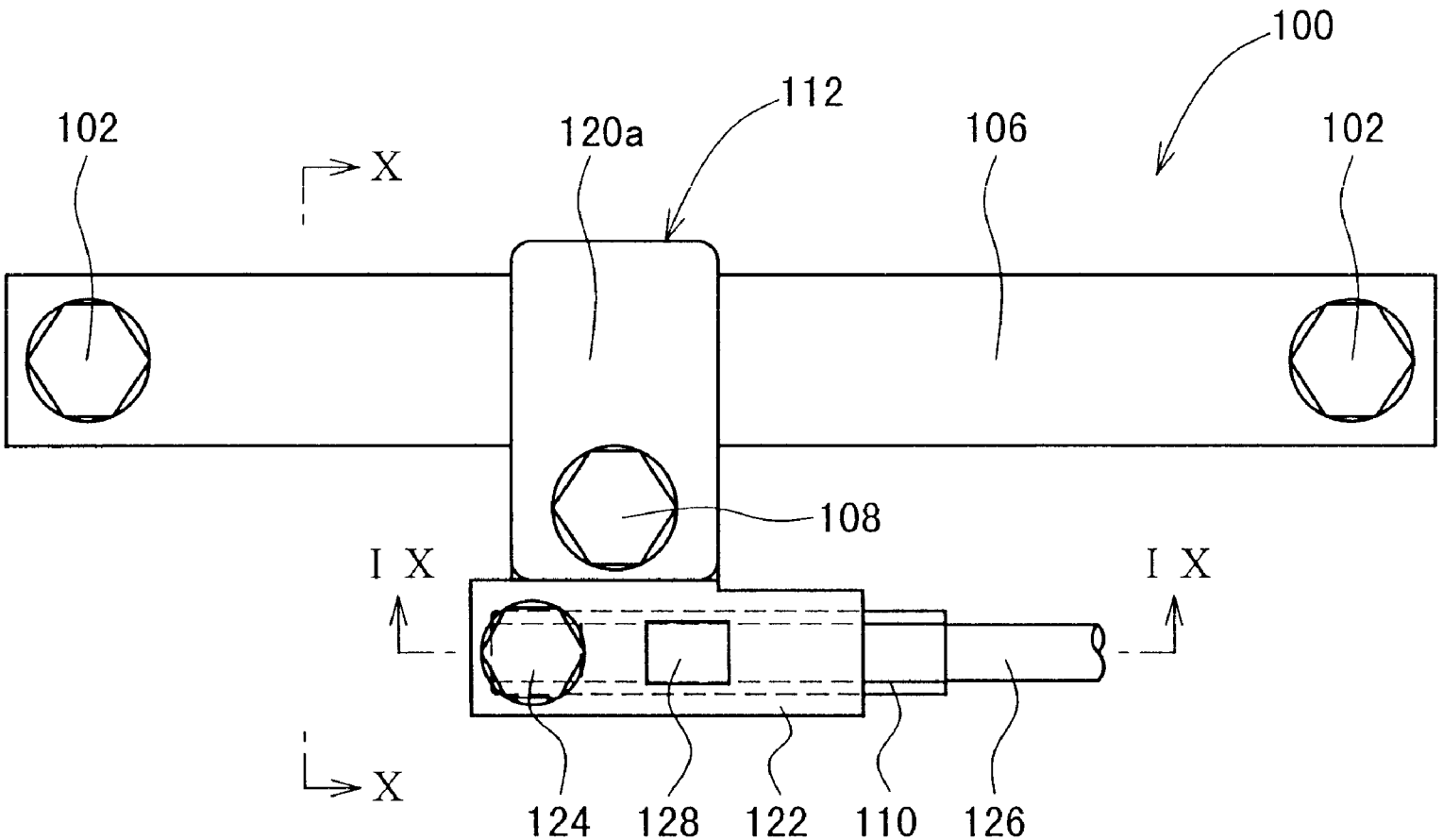
FIG. 8 shows a plan view illustrating the sensor attachment mechanism shown in FIG. 6.
Figure 9:
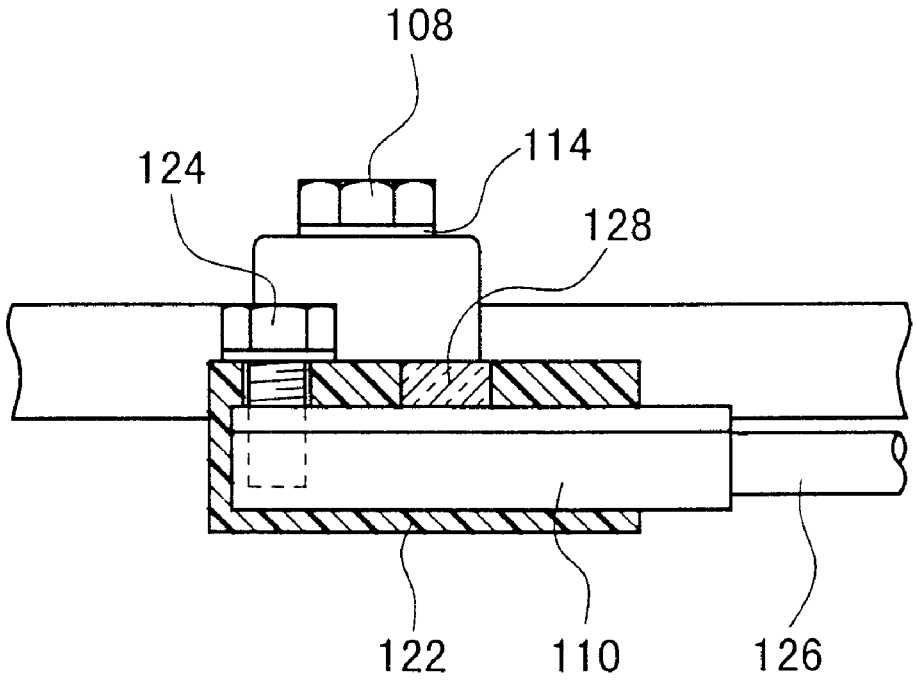
FIG. 9 shows a longitudinal sectional view taken along a line IX—IX shown in FIG. 8.
Figure 10:
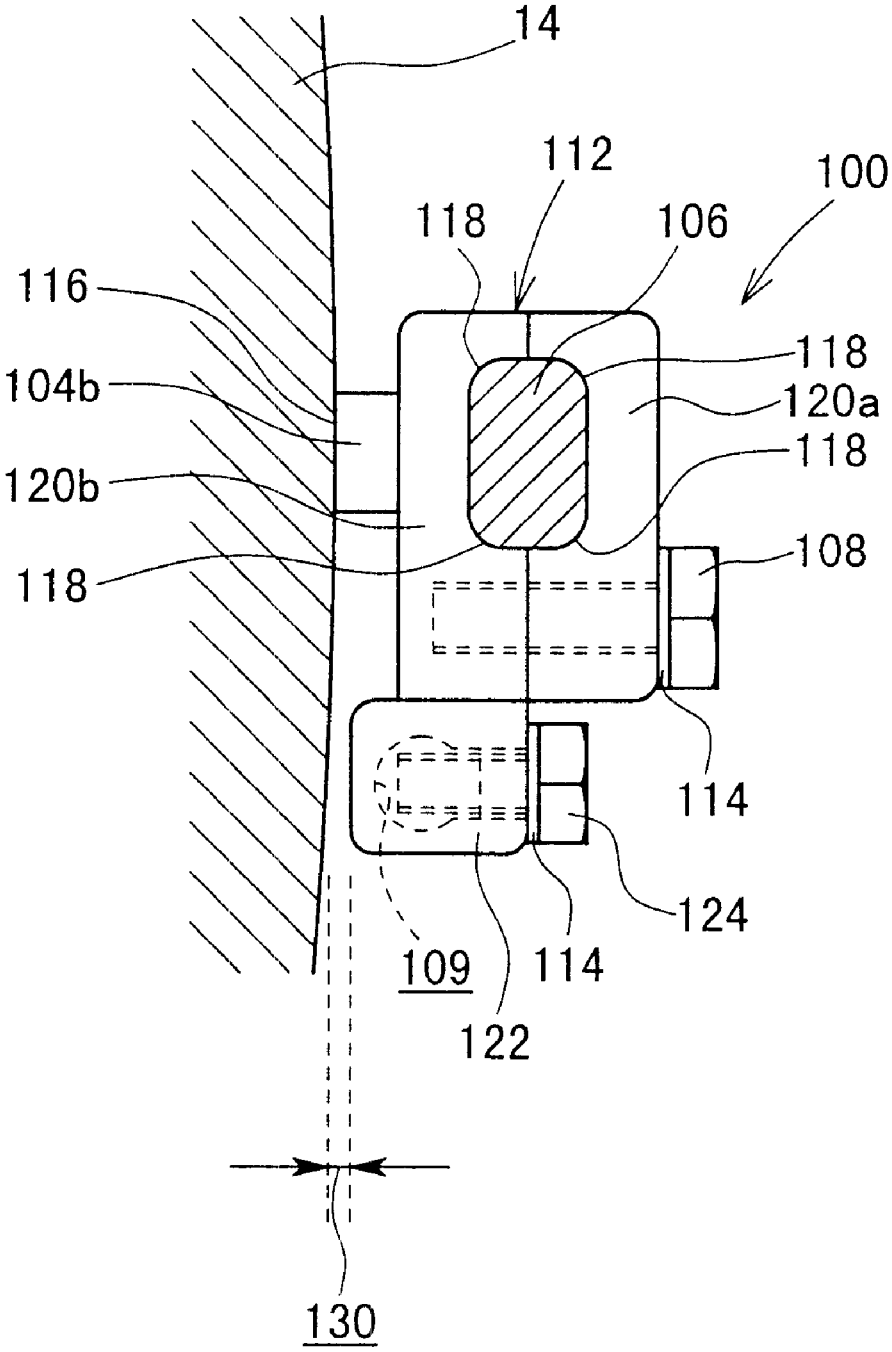
FIG. 10 shows a vertical sectional view taken along a line X—X shown in FIG. 8.

As shown in FIGS. 1 and 6 to 10, the sensor attachment mechanism 100 includes a pair of legs 104*a*, 104*b* which are secured to the side surface of the cylinder tube 14 while being separated from each other by a predetermined spacing distance such that hexagon head bolts 102, each of which has a hexagonal head, are screwed into screw holes formed on the side surface of the cylinder tube 14, a rail member 106 which is separated by a predetermined spacing distance from the side surface of the cylinder tube 14 and which is installed substantially in parallel to the piston rod 26 by the aid of the legs 104*a*, 104*b*, and a holder 112 which is provided adjustably to an arbitrary position in the axial direction of the rail member 106 by loosening a hexagon head bolt 108 and which has a holding section for holding a position-detecting sensor 110 by the aid of a hole 109 having a circular arc-shaped cross section (see FIG. 10). A ring-shaped plain washer 114, which functions to prevent the loosening, is installed to each of the hexagon head bolts 102, 108 (see FIG. 6).

In this arrangement, each of the legs 104*a*, 104*b*, the rail member 106, and the holder 112 may be formed of, for example, a synthetic resin material or a metal material such as aluminum alloy and stainless steel. In the embodiment of the present invention, as shown in FIG. 9, each of the legs 104*a*, 104*b*, the rail member 106, and the holder 112 is made of a synthetic resin material.

As shown in FIG. 10, the bottom surface 116 of each of the legs 104*a*, 104*b* to make abutment against the side surface of the cylinder 10 is formed to have a circular arc-shaped cross section having a predetermined radius of curvature corresponding to the curved side surface of the cylinder tube 14.

As shown in FIG. 10, the rail member 106 is formed to have a substantially oblong cross section with its outer surface four corners which are chamfered respectively to provide chamfered sections 118 each having a predetermined radius of curvature. No recess is provided at all on the outer surface of the rail member 106. Therefore, the rail member 106 is formed so that any liquid adhered to the outer surface of the rail member 106 spontaneously drips and falls with ease. The shape of the rail member 106 is not limited to have the substantially oblong cross section. The rail member 106 may have a non-circular configuration such as one having an elliptic cross section in order to achieve the function to avoid rotation of the holder 112 for holding the position-detecting sensor 110.

Figure 7:
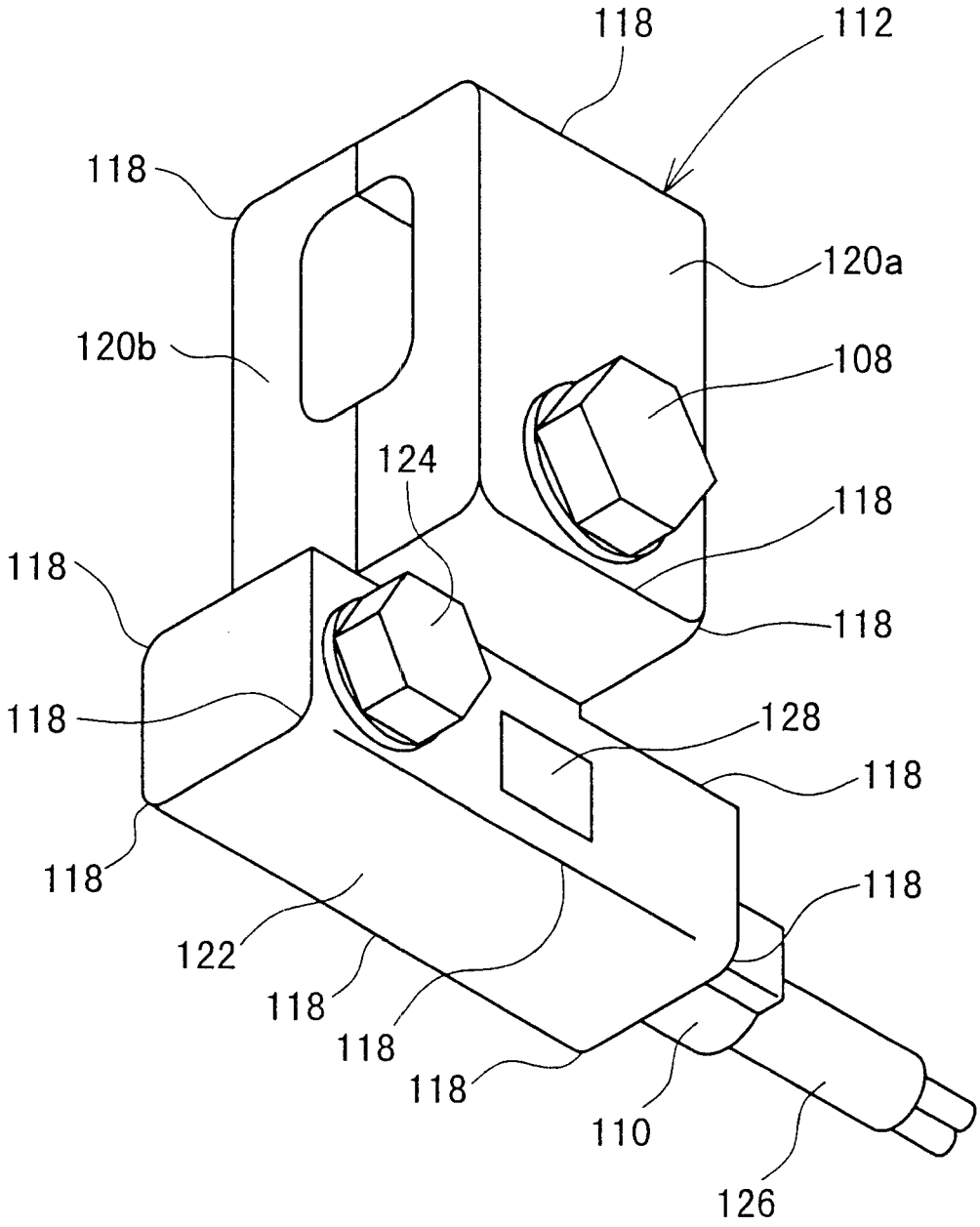
FIG. 7 shows a perspective view illustrating a holder which constitutes the sensor attachment mechanism shown in FIG. 6.

As shown in FIGS. 7 and 10, the holder 112 includes two divided parts, i.e., a first casing 120*a* and a second casing

120*b* which are integrally connected to one another by the aid of the hexagon head bolt 108. The second casing 120*b*, which is disposed closely to the outer surface of the cylinder tube 14, is integrally formed with the holding section 122 which protrudes in the side direction and which holds the position-detecting sensor 110 by the aid of the hole 109 having the circular arc-shaped cross section.

In this arrangement, the holder 112 is provided positionally adjustably to a desired position in the axial direction of the rail member 106 (in the stroke direction of the cylinder 10) after loosening the hexagon head bolt 108.

The holding section 122 has the hole 109 having the circular arc-shaped cross section which is formed in the axial direction of the rail member 106, the hole 109 having a closed end and an open end. The position-detecting sensor 110, which has a shape corresponding to the cross-sectional configuration of the hole 109 and which is formed as a separate member, is inserted and fitted into the hole 109.

An attachment screw 124, which fastens the position-detecting sensor 110 at a desired position in the hole 109 by making penetration through the position-detecting sensor 110 and pressing the inner wall surface of the hole 109 in accordance with the increasing action of the screwing amount, is provided at one end of the position-detecting sensor 110. A lead wire 126 is connected to the other end of the position-detecting sensor 110.

As shown in FIGS. 7 to 9, an indicator section 128 having an oblong shape, through which the emitted light from an unillustrated light-emitting element is visible when the magnet 60 of the piston 24 is sensed, is provided at an intermediate portion of the position-detecting sensor 110. The indicator section 128 is formed of a transparent or semi-transparent member. An appropriate clearance 130 is provided between the holding section 122 and the side surface of the cylinder tube 14. The position-detecting sensor 110 is arranged in a non-contact state with respect to the outer surface of the cylinder tube 14 (see FIG. 10).

That is, liquid pool may be generated when the position-detecting sensor 110 contacts with the outer surface of the cylinder tube 14. Further, considering the drainage performance for the liquid adhered to the outer surface of the cylinder tube 14, it is preferable that the position-detecting sensor 110 is in a floating state by the aid of the appropriate clearance 130. In this case, it is preferable that the appropriate clearance 130 is, for example, about 1 to 2 mm.

An unillustrated detecting element, which is composed of, for example, a Hall element or a magnetoresistive element, is provided in the position-detecting sensor 110. A detection signal can be led to the external equipment via the lead wire 126.

The chamfered sections 118, each of which is chamfered and each of which has the predetermined radius of curvature, are formed at angular portions and ridge portions of the holder 112 including the holding section 122 in order that the adhered liquid drips and falls with ease.

The cylinder 10, to which the sensor attachment mechanism 100 according to the embodiment of the present invention is applied, is basically constructed as described above. Next, its operation, function, and effect will be explained.

A pressure fluid (for example, air) is supplied from an unillustrated pressure fluid supply source to the first pressure fluid inlet/outlet port 12*a*. The pressure fluid, which is supplied to the first pressure fluid inlet/outlet port 12*a*, is introduced into the first cylinder chamber 22*a* via the passage 32*a*. Accordingly, the piston 24 is pressed toward the second cylinder chamber 22*b*.

When the piston 24 arrives at the displacement terminal end position in accordance with the action of the pressure fluid, the magnetic field of the magnet 60 installed to the piston 24 is sensed by the unillustrated detecting element of the position-detecting sensor 110. The position-detecting sensor 110 feeds the detection signal to the external equipment such as an unillustrated controller via the lead wire 126.

When the supply of the pressure fluid is switched from the first pressure fluid inlet/outlet port 12*a* to the second pressure fluid inlet/outlet port 12*b* in accordance with the switching action of an unillustrated directional control valve, then the piston 24 is displaced in the direction opposite to the above, and it is restored to the initial position. By doing so, the piston 24, which is accommodated in the cylinder tube 14, is successfully subjected to the reciprocating movement along the cylinder chamber 22.

When the cylinder 10, which is equipped with the position-detecting sensor 110 by the aid of the sensor attachment mechanism 100, is assembled, for example, to an unillustrated food processing machine to perform, for example, a washing operation, then any liquid adhered to the outer surfaces of the cylinder tube 14 and the sensor attachment mechanism 100 drips and falls with ease, and it is possible to avoid any occurrence of liquid pool on the outer surfaces of the cylinder tube 14 and the sensor attachment mechanism 100, because all of the outer circumferential surface of the cylinder tube 14 in the circumferential direction is constructed by the convex curved surfaces and the first to third chamfered sections 42, 44, 46 which are convex toward the outside, and the holder 112, the rail member 106, and other components for constructing the sensor attachment mechanism 100 are constructed by the chamfered sections 118 each of which has the predetermined radius of curvature.

As described above, the cylinder 10, which is equipped with the position-detecting sensor 110 by the aid of the sensor attachment mechanism 100, has such a contour shape that the liquid is scarcely kept on the outer surface, and the adhered liquid spontaneously drips and falls. Thus, it is possible to avoid the propagation of various germs, and it is possible to avoid the sanitary problem.

Further, the holder 112 including the holding section 122 can be positionally adjusted to a desired position in the axial direction of the rail member 106 (in the stroke direction of the cylinder 10) by loosening the hexagon head bolt 108 provided for the holder 112. In this case, the holder 112 is displaced along the rail member 106. Therefore, it is possible to set a large range of positional adjustment corresponding to the length of the rail member 106.

When the sensor attachment mechanism 100 is not used, the screw holes, which are formed on the side surface 38*b* of the cylinder 10, may be closed with unillustrated closing means such as bolts provided with seal washers.

Figure 5:
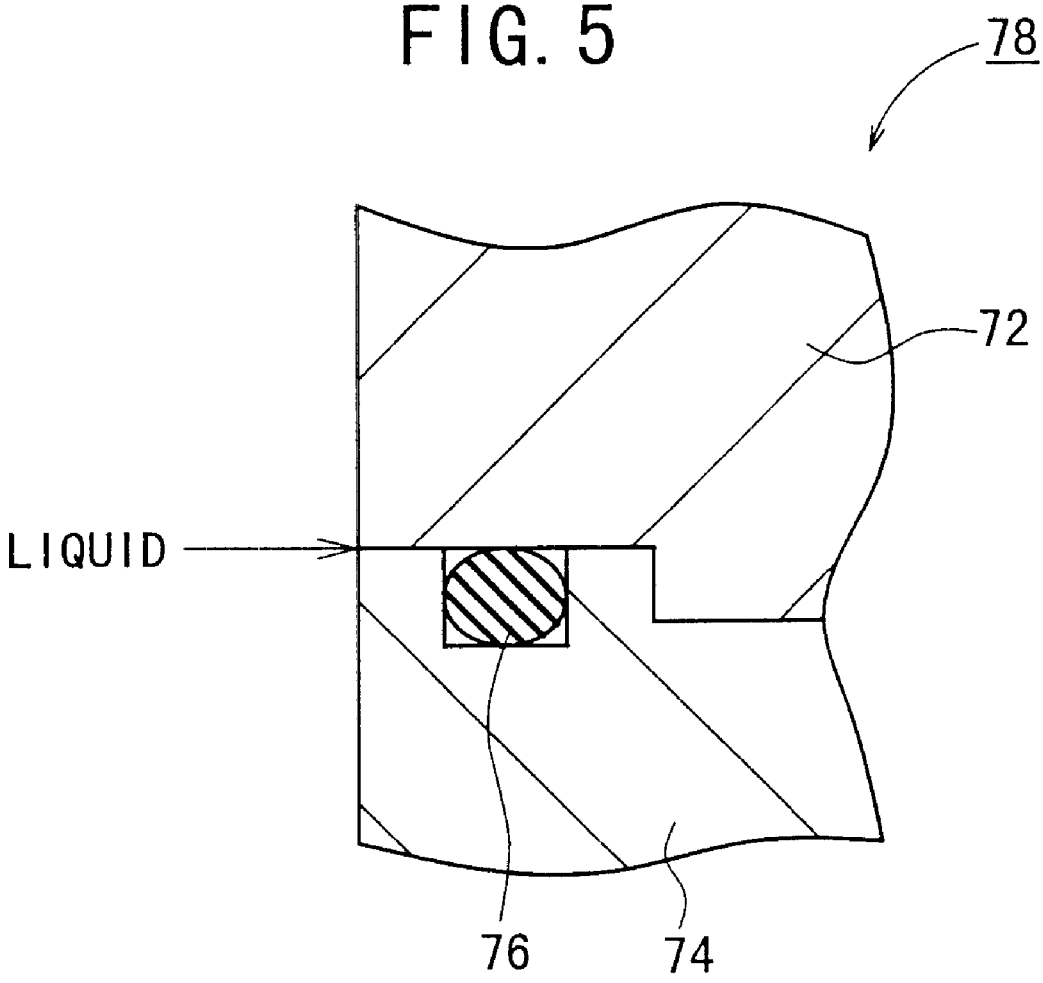
FIG. 5 shows a partial magnified longitudinal sectional view illustrating a cylinder concerning Comparative Example.
Figure 6:
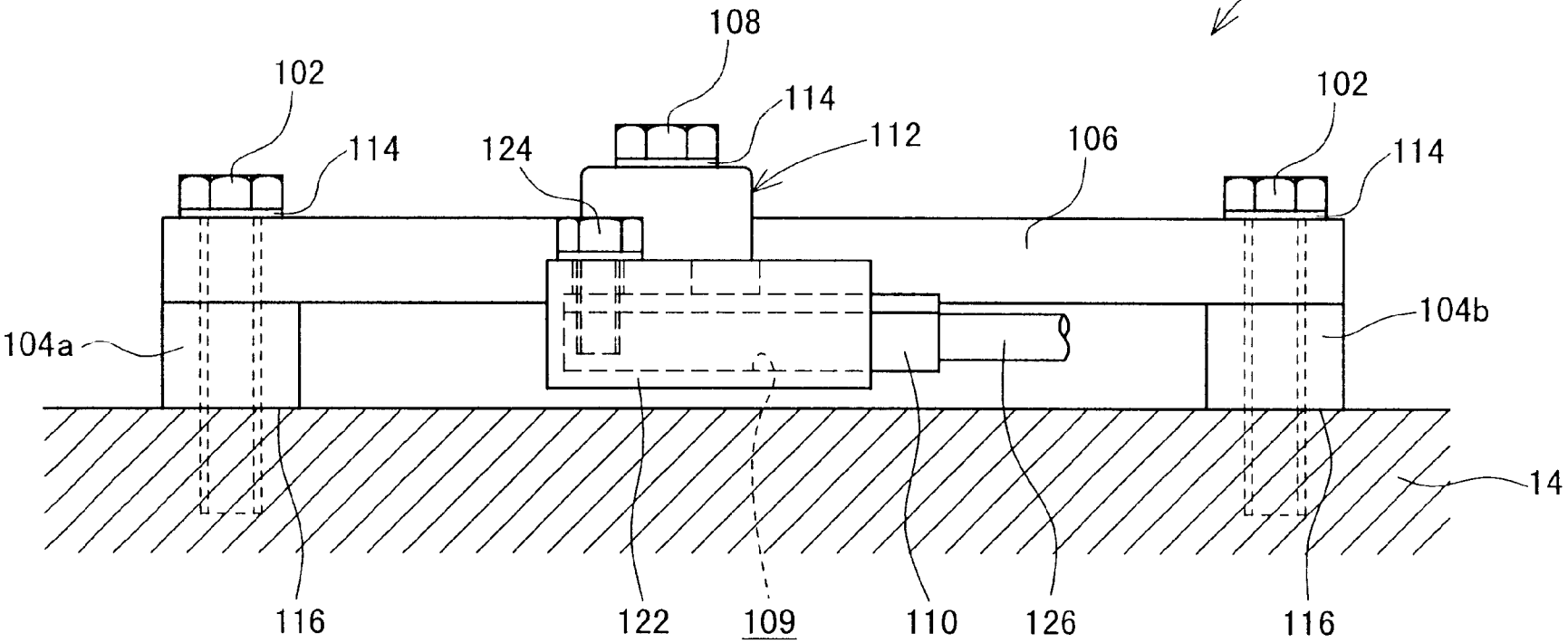
FIG. 6 shows a front view illustrating the sensor attachment mechanism according to the embodiment of the present invention.

As shown in FIG. 4, the cylinder 10 uses the seal member 62 which is previously provided with the press margin to be forcibly interposed under pressure between the inner circumferential surface 66 of the cylinder tube 14 and the annular projection 64 formed on the outer circumferential surface of the rod cover 18. In contrast, as shown in FIG. 5, in the case of a cylinder 78 concerning Comparative Example in which an O-ring 76 having a circular cross section is installed to a connecting portion between a cylinder tube 72 and a rod cover 74, the liquid or the like makes invasion from the outside up to the portion at which the O-ring 76 is installed via the connecting portion between the cylinder tube 72 and the rod cover 74, and various germs are propagated due to the liquid or the like.

In other words, the O-ring 76, which is provided for the cylinder 78 concerning Comparative Example, has only a function to avoid the leakage of the air in the cylinder chamber to the outside. The liquid, which makes invasion via the connecting portion between the cylinder tube 72 and the rod cover 74, is capable of making further invasion up to the portion at which the O-ring 76 is installed. Therefore, various germs are propagated with ease due to the liquid.

In contrast, in the case of the cylinder 10, as shown in FIG. 4, the sealing is reliably effected owing to the forcibly interposed section 68 of the seal member 62. Accordingly, it is possible to reliably prevent any invasion of liquid or the like from the outside into the cylinder tube 14 via the connecting portion between the cylinder tube 14 and the rod cover 18. As a result, the propagation of various germs, which would be otherwise caused by the liquid or the like invaded into the cylinder tube 14, is prevented. The sanitary problem is avoided from this viewpoint as well.

The embodiment of the present invention has been explained as exemplified by the case in which the cylinder 10 is equipped with the position-detecting sensor 110. However, there is no limitation thereto. It is a matter of course that the present invention may be applied, for example, to various fluid pressure-operated apparatuses such as unillustrated linear actuators and electric actuators.

Next, a sensor attachment mechanism 140 according to another embodiment is shown in FIGS. 11 to 14. In the embodiment described below, the same constitutive components as those of the sensor attachment mechanism 100 shown in FIG. 1 are designated by the same reference numerals, detailed explanation of which will be omitted.

Figure 14:
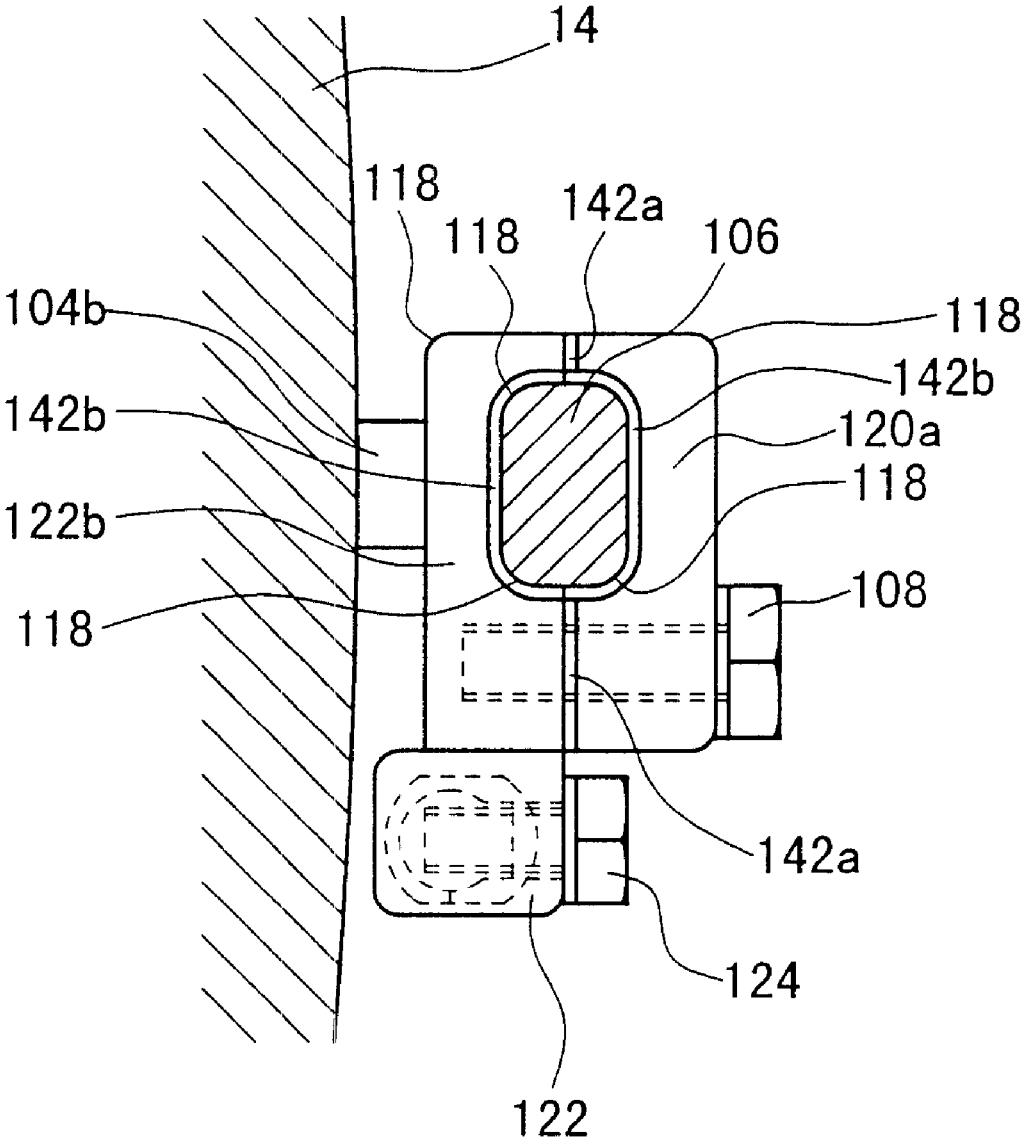
FIG. 14 shows a vertical sectional view taken along a line XIV—XIV shown in FIG. 12.

In the sensor attachment mechanism 140 according to the another embodiment, a rubber lining 142*a* (seal member) is interposed between a first casing 120*a* and a second casing 120*b* constructed as two divided parts, and a rubber lining 142*b* (seal member) is provided in a recess of a holder 112 (first casing 120*a* and second casing 120*b*) for surrounding the outer circumferential surface of a rail member 106 (see FIG. 14).

Figure 11:
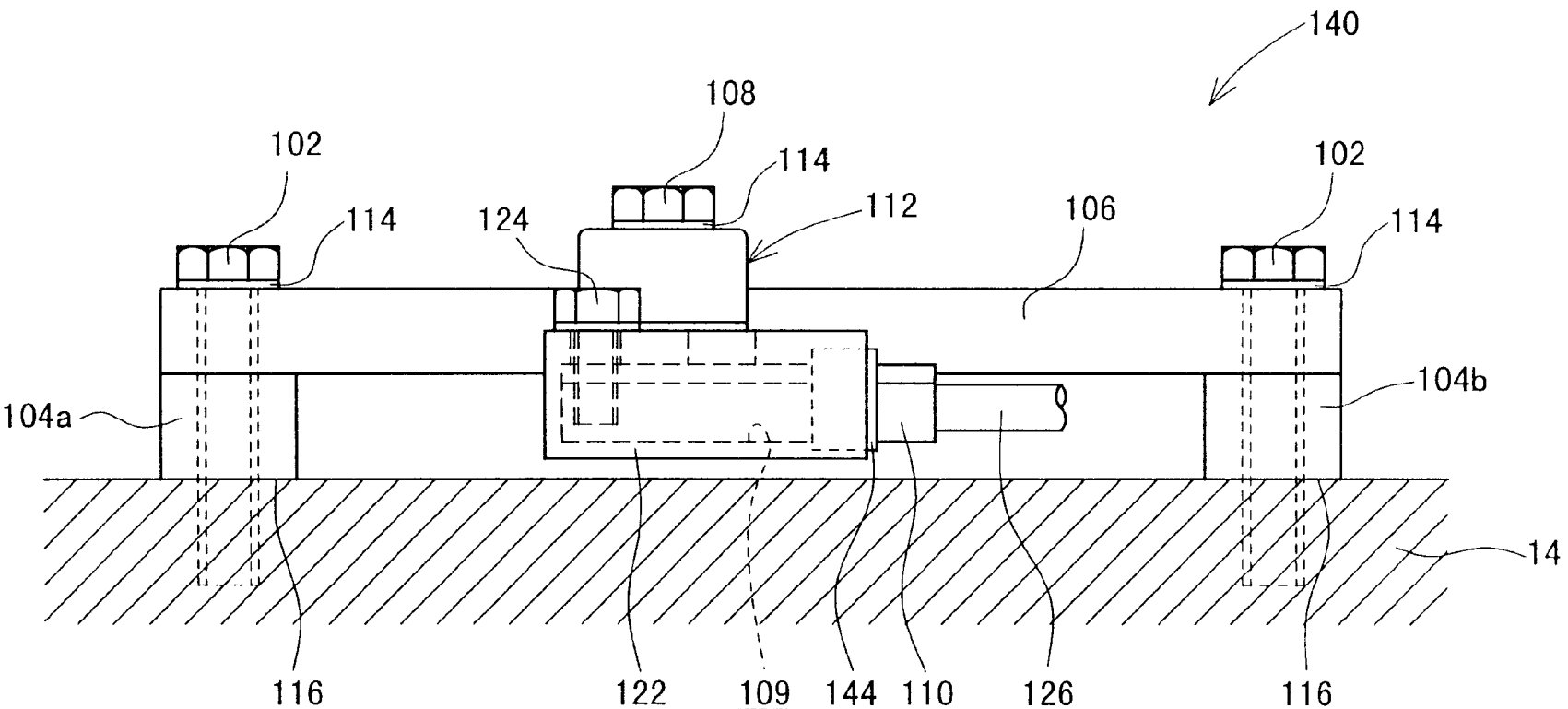
FIG. 11 shows a front view illustrating a sensor attachment mechanism according to another embodiment of the present invention.
Figure 12:
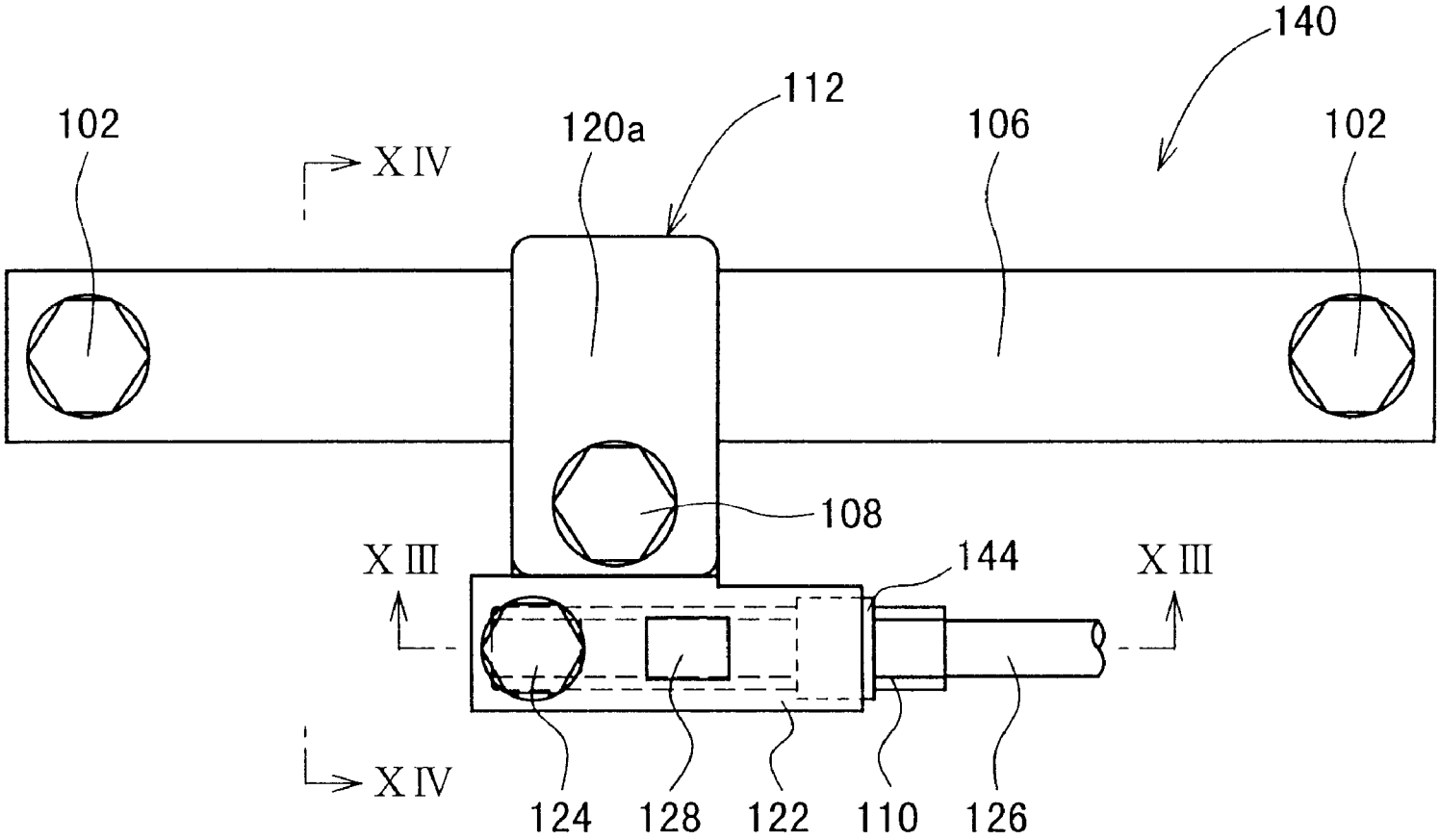
FIG. 12 shows a plan view illustrating the sensor attachment mechanism shown in FIG. 11.
Figure 13:
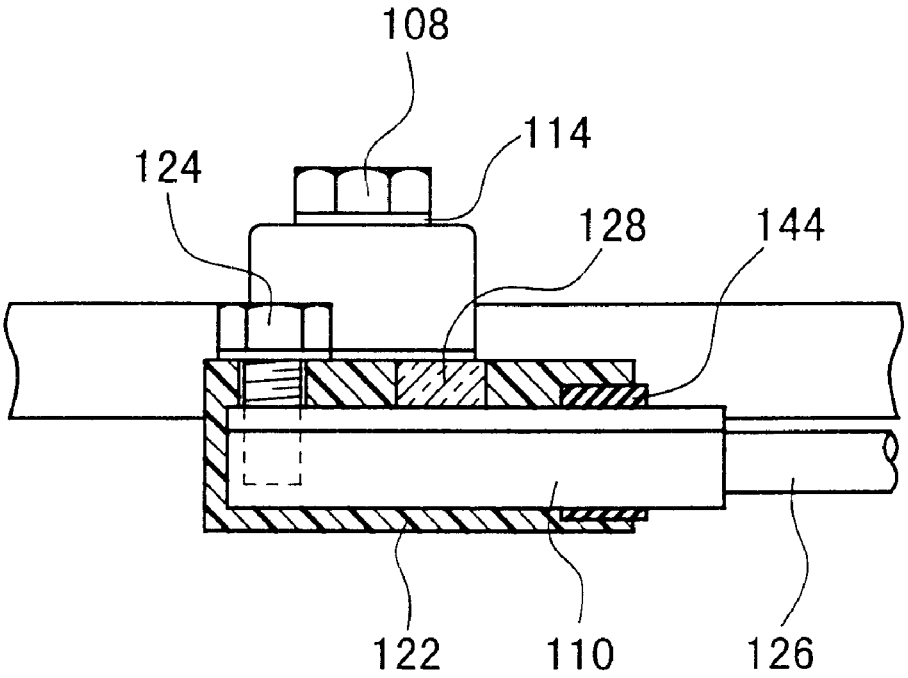
FIG. 13 shows a longitudinal sectional view taken along a line XIII—XIII shown in FIG. 12.

In the sensor attachment mechanism 140 described above, a gasket 144 (seal member), which is composed of, for example, hard rubber, is installed to an opening of a hole 109 to which the position-detecting sensor 110 is installed (see FIGS. 11 to 13).

The sensor attachment mechanism 140 has the following advantage owing to the provision of the rubber linings 142*a*, 142*b* and the gasket 144 which function as the seal members as described above. That is, it is possible to reliably prevent the invasion of any liquid. Further, it is possible to improve the sealing performance between the rail member 106 and the holder 112 which is externally fitted to the rail member 106.

Figure 15:
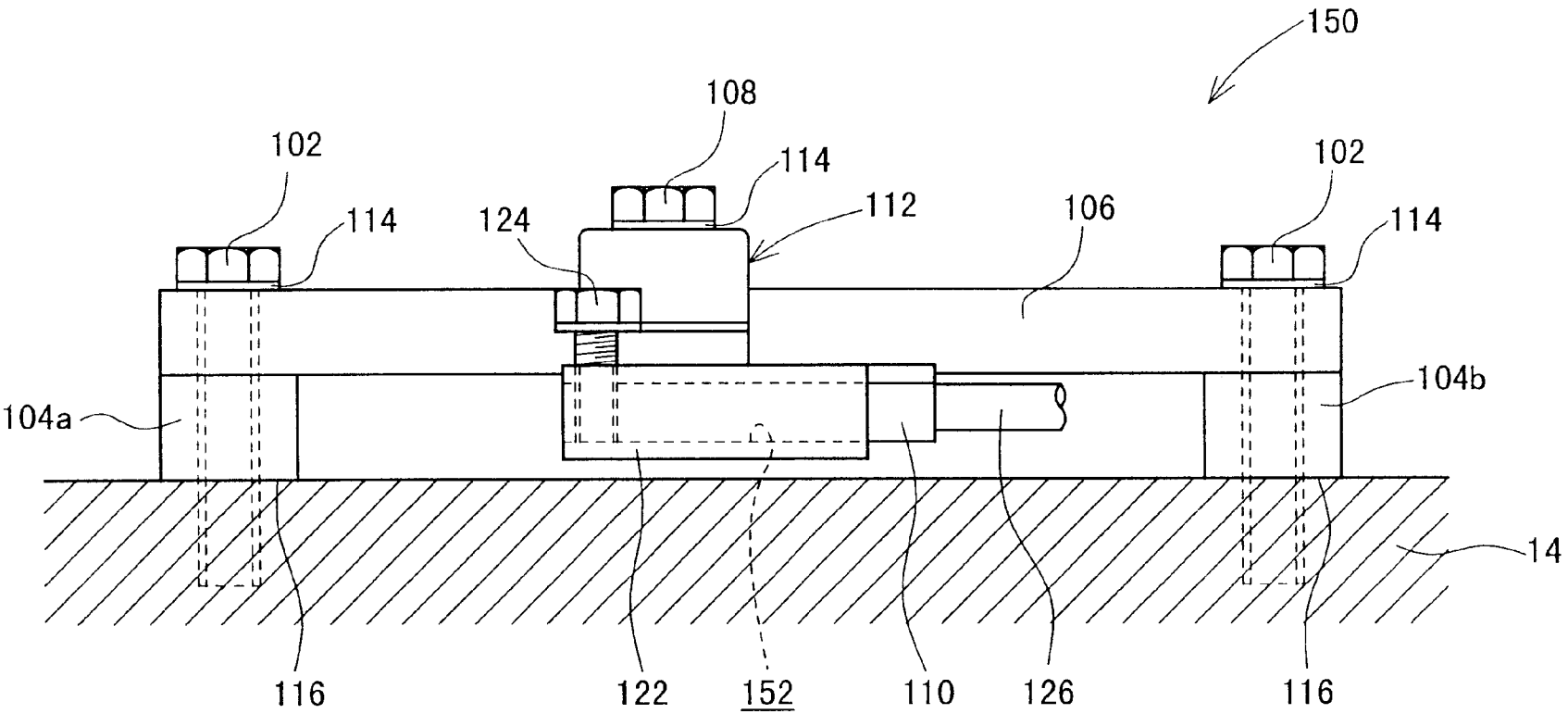
FIG. 15 shows a front view illustrating a sensor attachment mechanism according to still another embodiment of the present invention.
Figure 16:
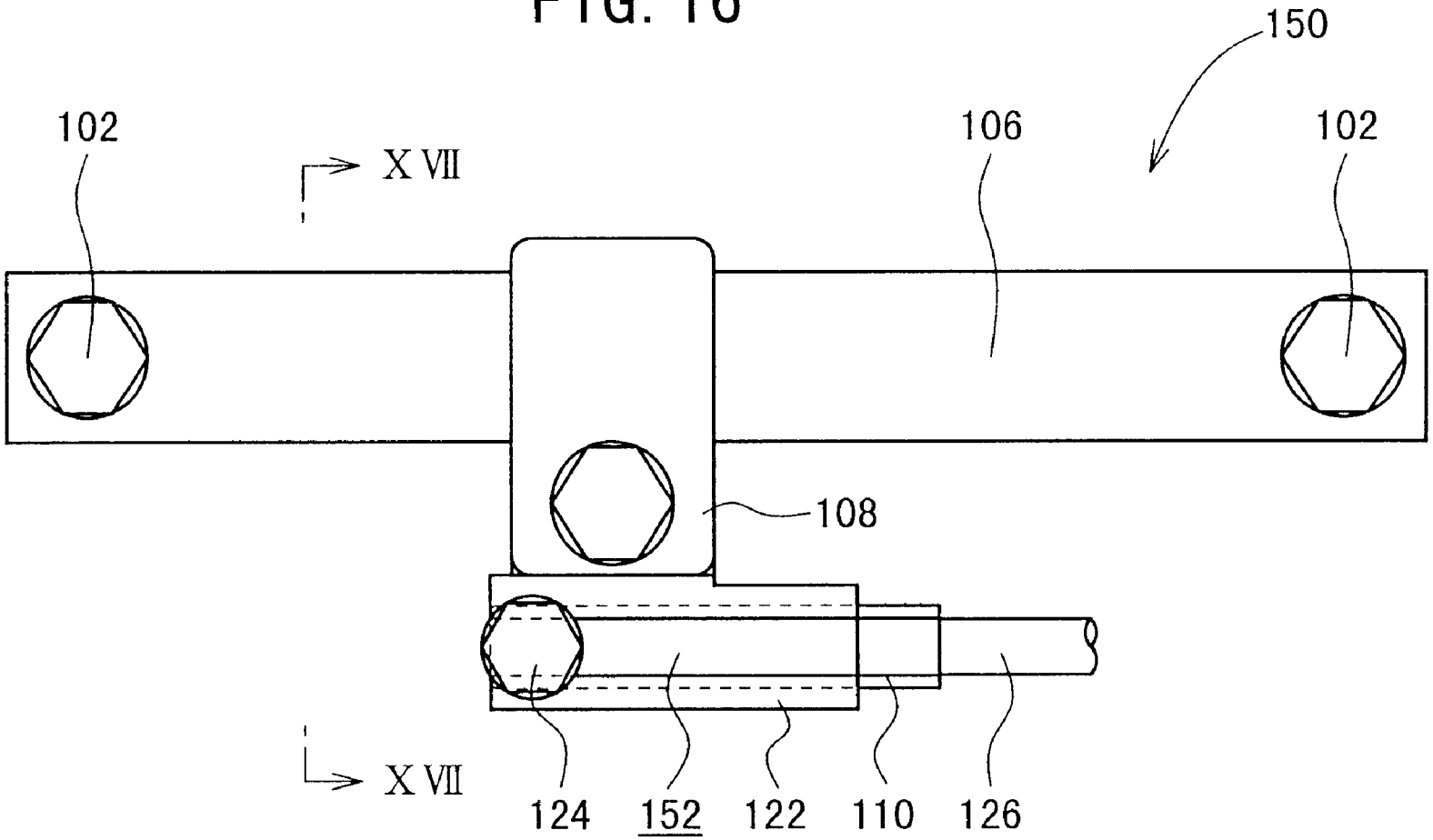
FIG. 16 shows a plan view illustrating the sensor attachment mechanism shown in FIG. 15.
Figure 17:
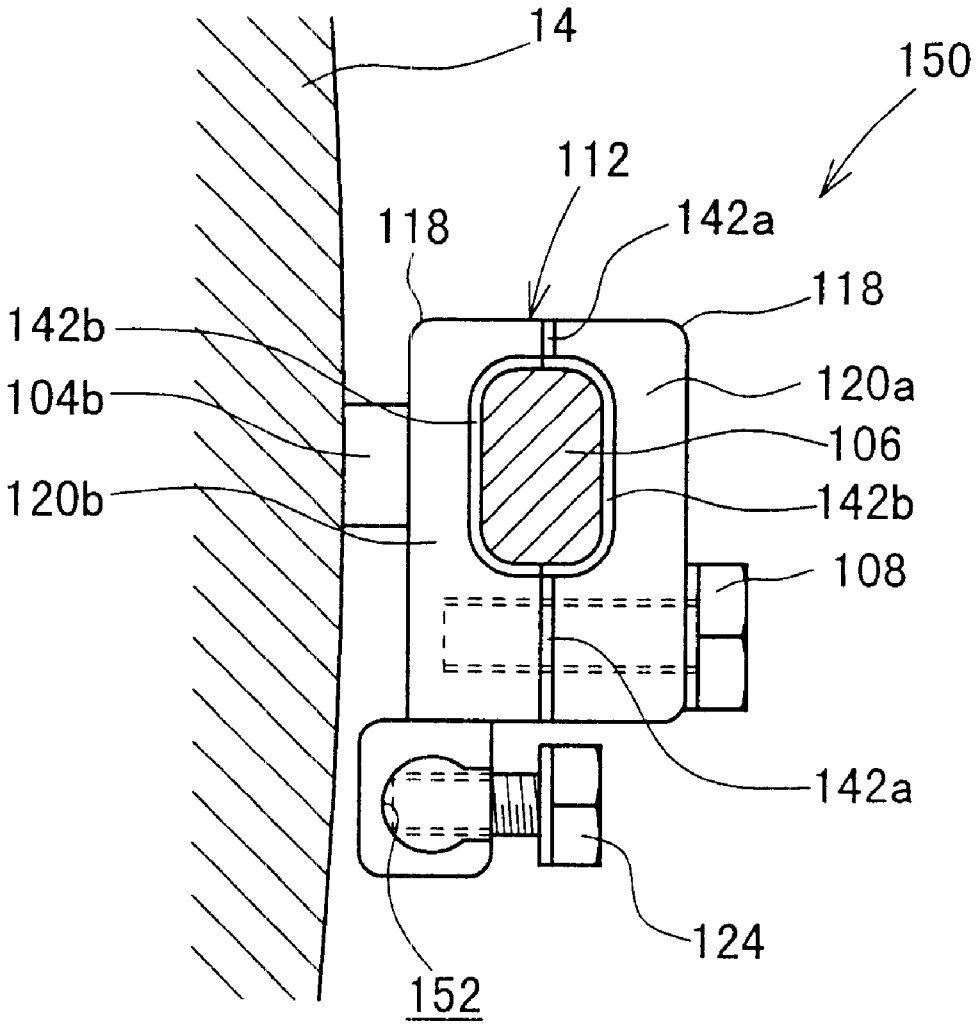
FIG. 17 shows a vertical sectional view taken along a line XVII—XVII shown in FIG. 15.

Next, a sensor attachment mechanism 150 according to still another embodiment is shown in FIGS. 15 to 17.

In the sensor attachment mechanism 150 according to the still another embodiment, a penetrating long groove 152 having a circular arc-shaped cross section is formed in place of the hole 109 formed for the holding section 122. The sensor attachment mechanism 150 has the following advantage owing to the formation of the penetrating long groove 152 as described above. That is, the position of the position-detecting sensor 110 itself can be finely adjusted along the long groove 152 in a state in which the holder 112 positioned at a desired position on the rail member 106 is fixed.

In this embodiment, the cross-sectional configuration of the long groove 152 is not limited to the circular arc-shaped configuration. The cross-sectional configuration may be a non-circular configuration to effect the function to prevent rotation of the position-detecting sensor 110 in the circumferential direction.

The other effects and functions of the sensor attachment mechanisms 140, 150 are the same as those of the sensor attachment mechanism 100 shown in FIG. 1, detailed explanation of which is omitted.

While the invention has been particularly shown and described with reference to preferred embodiments, it will be understood that variations and modifications can be effected thereto by those skilled in the art without departing from the spirit and scope of the invention as defined by the appended claims.

What is claimed is:

1. A cylinder tube and attachment structure for attaching a position-detecting sensor to said cylinder tube for detecting a position of a piston accommodated in a cylinder chamber of said cylinder tube, said attachment structure for said position-detecting sensor comprising:

said position-detecting sensor including a detecting element for sensing a magnetic field of a magnet installed on said piston; and a sensor attachment mechanism for holding said position-detecting sensor so that said position-detecting sensor is separated by a predetermined spacing distance from an outer side surface of said cylinder tube, wherein said sensor attachment mechanism includes a rail member which is secured to said outer side surface of said cylinder tube, and a holder which holds said position-detecting sensor and which is provided slidably along said rail member, and wherein chamfered sections, each of which is chamfered with a predetermined radius of curvature, are formed for said rail member and said holder.

2. The cylinder tube and attachment structure according to claim 1, wherein said holder has a holding section for holding said position-detecting sensor, and a clearance is provided between said holding section and said cylinder tube.

3. The cylinder tube and attachment structure according to claim 2, wherein a seal member for preventing invasion of liquid is provided for said holding section for holding said position-detecting sensor.

4. The cylinder tube and attachment structure according to claim 2, wherein said holding section is provided with an indicator section through which emitted light is visually observable when said position-detecting sensor senses said magnetic field of said magnet installed to said piston.

5. The cylinder tube and attachment structure according to claim 1, wherein a long groove, which extends in a longitudinal direction, is formed for said holding section, and said position-detecting sensor is provided positionally adjustably along said long groove.

6. The cylinder tube and attachment structure according to claim 1, wherein said holder is externally fitted to said rail member, and a seal member is provided in a recess of said holder for surrounding said rail member.

7. The cylinder tube and attachment structure according to claim 1, wherein said holder is constructed by two divided parts comprising a first casing and a second casing, and a seal member is interposed between said first casing and said second casing.

8. A cylinder tube and attachment structure for attaching a position-detecting sensor to said cylinder tube for detecting a position of a piston accommodated in a cylinder chamber of said cylinder tube, said attachment structure for said position-detecting sensor comprising:

said position-detecting sensor including a detecting element for sensing a magnetic field of a magnet installed on said piston; and a sensor attachment mechanism for holding said position-detecting sensor so that said position-detecting sensor is separated by a predetermined spacing distance from an outer side surface of said cylinder tube, wherein said sensor attachment mechanism includes a rail member which is secured to said outer side surface of said cylinder tube, and a holder which holds said position-detecting sensor and which is provided slidably along said rail member, and wherein said holder has a holding section for holding said position-detecting sensor, and a clearance is provided between said holding section and said cylinder tube.

9. The cylinder tube and attachment structure according to claim 8, wherein chamfered sections, each of which is chamfered with a predetermined radius of curvature, are formed for said rail member and said holder.

10. The cylinder tube and attachment structure according to claim 8, wherein a long groove, which extends in a longitudinal direction, is formed for said holding section, and said position-detecting sensor is provided positionally adjustably along said long groove.

11. The cylinder tube and attachment structure according to claim 8, wherein said holder is externally fitted to said rail member, and a seal member is provided in a recess of said holder for surrounding said rail member.

12. The cylinder tube and attachment structure according to claim 8, wherein said holder is constructed by two divided parts comprising a first casing and a second casing, and a seal member is interposed between said first casing and said second casing.

13. The cylinder tube and attachment structure according to claim 8, wherein a seal member for preventing invasion of liquid is provided for said holding section for holding said position-detecting sensor.

14. The cylinder tube and attachment structure according to claim 8, wherein said holding section is provided with an indicator section through which emitted light is visually observable when said position-detecting sensor senses said magnetic field of said magnet installed to said piston.

15. A cylinder tube and attachment structure for attaching a position-detecting sensor to said cylinder tube for detecting a position of a piston accommodated in a cylinder chamber of said cylinder tube, said attachment structure for said position-detecting sensor comprising:

said position-detecting sensor including a detecting element for sensing a magnetic field of a magnet installed on said piston; and a sensor attachment mechanism for holding said position-detecting sensor so that said position-detecting sensor is separated by a predetermined spacing distance from an outer side surface of said cylinder tube, wherein said sensor attachment mechanism includes a rail member which is secured to said outer side surface of said cylinder tube, and a holder which holds said position-detecting sensor and which is provided slidably along said rail member, and wherein said holder has a holding section for holding said position-detecting sensor, and said holding section is provided with an indicator section through which emitted light is visually observable when said position-detecting sensor senses said magnetic field of said magnet installed to said piston.

16. The cylinder tube and attachment structure according to claim 15, wherein chamfered sections, each of which is chamfered with a predetermined radius of curvature, are formed for said rail member and said holder.

17. The cylinder tube and attachment structure according to claim 15, wherein a clearance is provided between said holding section and said cylinder tube.

18. The cylinder tube and attachment structure according to claim 15, wherein a long groove, which extends in a longitudinal direction, is formed for said holding section, and said position-detecting sensor is provided positionally adjustably along said long groove.

19. The cylinder tube and attachment structure according to claim 15, wherein said holder is externally fitted to said rail member, and a seal member is provided in a recess of said holder for surrounding said rail member.

20. The cylinder tube and attachment structure according to claim 15, wherein said holder is constructed by two divided parts comprising a first casing and a second casing, and a seal member is interposed between said first casing and said second casing.

21. The cylinder tube and attachment structure according to claim 15, wherein a seal member for preventing invasion of liquid is provided for said holding section for holding said position-detecting sensor.

* * * * *